United States Patent [19]

Carling

[11] 4,008,019

[45] Feb. 15, 1977

[54] ROTARY PUMP WITH PIVOTED FLAP ENGAGING A BLADED ROTOR

[75] Inventor: Helge Carling, Oslo, Norway

[73] Assignee: Myrens Verksted A/S, Oslo, Norway

[22] Filed: June 9, 1975

[21] Appl. No.: 584,929

[30] Foreign Application Priority Data

June 14, 1974 Norway ..... 742174

[52] U.S. Cl. ..... 418/221; 418/15

[51] Int. Cl.[2] ..... F01C 1/00; F04C 1/00

[58] Field of Search ..... 418/15, 97, 221, 248, 418/249, 255, 266

[56] References Cited

UNITED STATES PATENTS

| | | | |
|---|---|---|---|
| 466,540 | 1/1892 | Lewis | 418/221 |
| 732,671 | 6/1903 | Andrews | 418/221 |
| 1,804,604 | 5/1931 | Gilbert | 418/15 |
| 1,833,275 | 11/1931 | Burmeister | 418/15 |
| 1,874,282 | 8/1932 | Godfrey | 418/255 |

FOREIGN PATENTS OR APPLICATIONS

| | | | |
|---|---|---|---|
| 9,433 | 1886 | United Kingdom | 418/221 |
| 471,885 | 9/1937 | United Kingdom | 418/221 |
| 2,666 | 1864 | United Kingdom | 418/248 |
| 268,179 | 7/1970 | U.S.S.R. | 418/15 |

*Primary Examiner*—John J. Vrablik

*Attorney, Agent, or Firm*—Holman & Stern

[57] ABSTRACT

A displacement pump of the blade or vane type comprising a rotor with two blades, said rotor being eccentrically mounted in the casing of the pump. The rotor with its blades provides for a first pumping effect so as to transport material in first partial volumes with a first pulsating characteristic having two maxima and two minima for every full rotation of the rotor. The rotor is constructed with circumferential sections between the blades, said sections being located inside the smallest circumscribed circle of the cross-section of the pump and uniformly merging with remaining circumferences of the rotor. Between the outlet and the inlet of the pump a pivotable flap is arranged. The flap with its front edge slidingly abuts against said circumferential sections of the rotor for thereby inducing a second pumping effect. This second pumping effect has a second pulsating characteristic also having two maxima and minima for every full rotation of the rotor. The maxima of said second pulsating characteristic coincide with the minima of said first pulsating characteristic, and the minima of said second characteristic coincide with the maxima of said first pulsating characteristic, for thereby providing a pump which yields a greater total pump capacity and gives a more even total supply characteristic.

7 Claims, 3 Drawing Figures

ROTARY PUMP WITH PIVOTED FLAP ENGAGING A BLADED ROTOR

FIELD OF THE INVENTION

The present invention relates to a displacement pump comprising a casing which defines a working chamber and which is provided with an inlet and an outlet being arranged substantially right-angled to each other and together extending across at least one quarter of the surface of the casing and communicating with said working chamber.

BACKGROUND OF THE INVENTION

A cylindrical rotor is eccentrically arranged in said working chamber, said rotor having two blades which are arranged in recesses in the rotor and which during operation are pressed against the inner surfaces of the working chamber, for thereby inducing a first pumping effect so as to transport the material in first partial volumes with a first pulsating characteristic having two maxima and two minima for every full rotation of the rotor.

Such pumps are generally used in the food industry for the transportation of raw material. The raw materials often consist of an inhomogeneous material which, may contain bits or pieces which during the transportation, are subjected to undesired comminution.

This is especially the case when the raw materials are transported in closed systems, something which is desirable when transporting easily tainted raw materials which have to be protected against air or give off inconvenient odours.

The purpose underlying the present invention is the task to devise a displacement pump to be used for the transportation of inhomogeneous material in a closed transportation system, said pump having to give an effective, even and careful transportation of the material. Especially in the fish flour and the fish oil industry, wherein the raw material consists of whole fish it is desirable that the fish during the transportation from the cargo compartment in the fishing vessel to the storage tanks in a least possible degree is to be subjected to severance or other breakage. In the following the invention will be disclosed with special reference to the transportation of substantially whole fish. In order to accomplish the transportation so effectively and gently as possible through the pump this must satisfy a series of requirements. Firstly, to avoid that the fish, which is to be transported, is cut or damaged by the blades it is desirable to design the pump with as few blades as practically possible. However, when the pump has only few blades, e.g. two, the supply characteristic of the pump will be very uneven, and the inlet and the outlet of the pump must be made relatively narrow. An uneven supply characteristic is undesired as this, besides from yielding an uneven supply, unnecessarily stresses both the drive machinery and the goods of transportation.

The prior art discloses a rotating pump wherein the rotor sections which lie between the recesses of the blades are shaped so that the outer surfaces lie inside the smallest circumscribed circle of the rotor. The outer surface of the rotor is, however, formed with very abrupt profile transitions, a construction which in no way can be combined with a pivotable flap arranged between the inlet and the outlet of the pump. Further, the pump according to the prior art is equipped with four blades which is very unfavourable for pumps which are to be used for an effective, even and gentle transportation of inhomogeneous material in a closed transporting system. Besides, the pump according to this earlier German patent specification will have a very poor efficiency as the increase of volume of the working chamber obtained by the removals of the rotor cannot be utilized for an increase of the capacity of the pump because the larger part of the displacement volume which is defined between the two blades at the outlet port will be maintained between the blades and rotate together with these passed the outlet port. The removals will substantially be filled with "dead water" which spoils any increment of the pumping capacity.

From U.S. Pat. No. 1,427,053 there is known a rotating internal combustion engine wherein the rotor sections which are located between the recesses of the blades, are shaped so that the profile of the cross-section lies within the circumscribed circle of the rotor. Between the inlet and the outlet of the engine there are arranged abutment blades which are pressed against the surface of the rotor by means of springs. However, the engine according to U.S. Pat. No. 1,427,053 embodies a rotor which is concentrically arranged in the motor casing. If the engine according to U.S. Pat. No. 1,427,053 should be applied as a pump with two approximately symmetrically shaped pumping chambers, such an arrangement would firstly give rise to very narrow inlet and outlet conditions, and the shape of the pump would moreover be very unfavourable. Further, the delivery characteristic of such a modified engine used as a pump would be very uneven as the delivery would be accomplished in a shocking or impacting manner, because the two displacement principles which are based upon a rotor with displacement blades in a casing without abutment blades and a rotor without blades in a casing with abutment blades come into effect in phase and are directly summed up. For an internal combustion engine such an addition of the two displacement effects in phase is generally without signification, but in a displacement pump which is to be used for the transportation of delicate material in the food industry, and which has to perform an even delivery characteristic, this displacement principle is unacceptable. Besides, a pump designed according to the teaching of U.S. Pat. No. 1,427,053 would qualify for a pump which in neutral position allows for a short circuit or reverse flow of the transported material.

SUMMARY OF THE INVENTION

The present invention have been contemplated in view of a displacement pump which houses an eccentrically arranged rotor, i.e. so-called blade pumps or vane pumps, and according to prior art such blade pumps have previously been equipped with a generally cylindrical rotor, the outer surface of the rotor in the area between the outlet and the inlet being in gliding abutment against the rotor casing for thereby constituting a fixed sealing between the inlet and outlet ports.

Accordingly, the present invention relates to a pump of the type indicated in the introductory paragraphs, and the pump according to the invention is primarily characterized in that sections of the cross-section of the rotor between the recesses of the blades are located inside the smallest circumscribed circle of the cross-section of the rotor and uniformly merge with the remaining circumference, and that a pivotable flap is arranged in the casing of the pump between the inlet and the outlet thereof, said flap having an edge which during the rotation of the rotor abuts against the outer surface of the rotor, whereby an additional displacement volume is achieved, said volume being added to the above mentioned partial volumes 90° shifted for thereby yielding a greater capacity and giving a more even supply characteristic of the pump.

According to the present invention there is provided a displacement pump by which is achieved an additional pumping effect, said additional pumping effect being due to the co-operation between the pivotable flap and the uniform transition sections between the recesses of the rotor blades. The additional pumping effect has a maximum when the first pumping effect due to the rotor blades has a minimum. Compared with conventional displacement pumps the present invention devices a pump having a delivery capacity which besides from being far more even is also larger than those obtained by known displacement pumps.

An especially preferred embodiment of the pump according to the invention is to the effect that the rotor consists of two substantially equally shaped parts having opposite circumferential sections with a double blade arranged therebetween. The flat sections of each rotor part at their edges which extend transversely relative to the direction of transportation then adjoin with convex approximately circularly arced surfaces circumferential sections having a radius of curvature which is less than the radius of curvature of the circumscribed circle of the rotor, and the convexly shaped circumferential sections evenly merge with an intermediate concave circumferential section.

Another characteristic feature of the pump according to the present invention is that a first transverse slot is provided in that section of the working chamber which merges with the outlet of the pump, said slot being connected to a first supply conduit. Through the supply conduit there may be delivered fish water (blood water) under pressure, preferably from the same level at which the transported material is present. By such an arrangement one will prevent that the material, e.g. the fish in fish water which is present at the outlet of the pump, is pressed back into the working chamber of the pump when a blade leaves the inner wall of the pump casing and enters into the outlet area.

A further feature of the pump according to the invention is that a second transverse slot is arranged in that section of the working chamber which proceeds to the inlet of the pump, said slot being connected to a second supply conduit.

By the supply of water or another suitable liquid under pressure, e.g. blood water from fish, the transported fish will be less subjected to cutting and damages from the ends of the blades when these from the inlet port enters that section of the pump casing which adjoin the inlet. Appropriately, valves or throttles may be provided in the supply conduits so that pressure water is supplied through the mentioned slots only during given time intervals, preferably when the ends of the blades are in the proximity of the slots and when the one blade end leaves the pump casing and enters the outlet, respectively when the second blade end leaves the outlet and enters the inner wall of the pump casing.

By the present invention there is achieved a displacement pump which is especially well suited for the transportation of fish as the pump transports the fish in a very careful manner and the supply characteristic is very even. The delivery rate of the pump is relatively high compared with known pumps for this purpose, something which is of great importance in emptying fishing vessels when these lie at the unloading place.

Further features and advantages of the invention will be described in more detail, reference being had to the accompanying drawings, which show an embodiment of the body of the invention.

DETAILED DESCRIPTION OF THE PREFERRED EMBODIMENT

Figure 1:
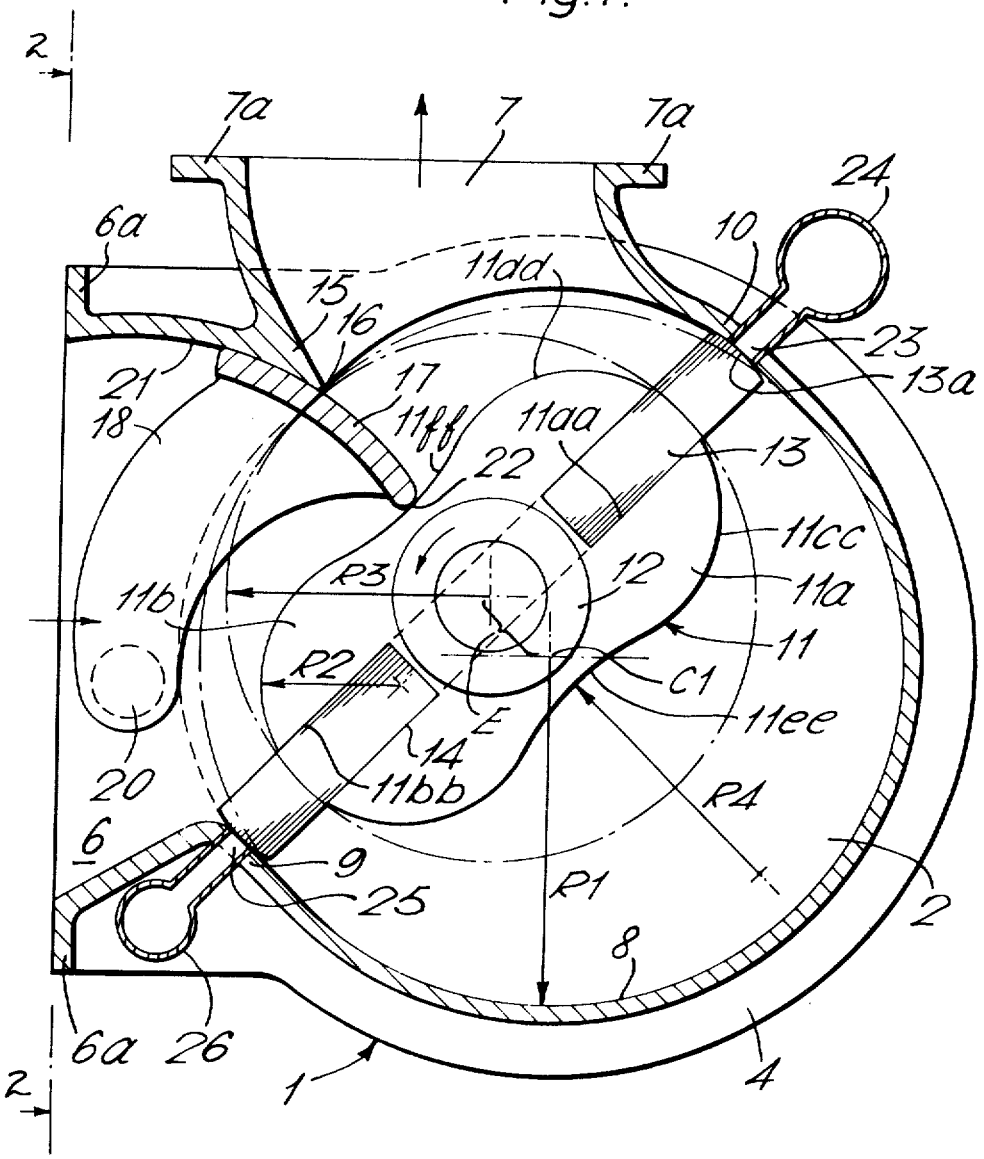
FIG. 1 is a section on line 1-1 of FIG. 2 through a pump according to the invention.
Figure 2:
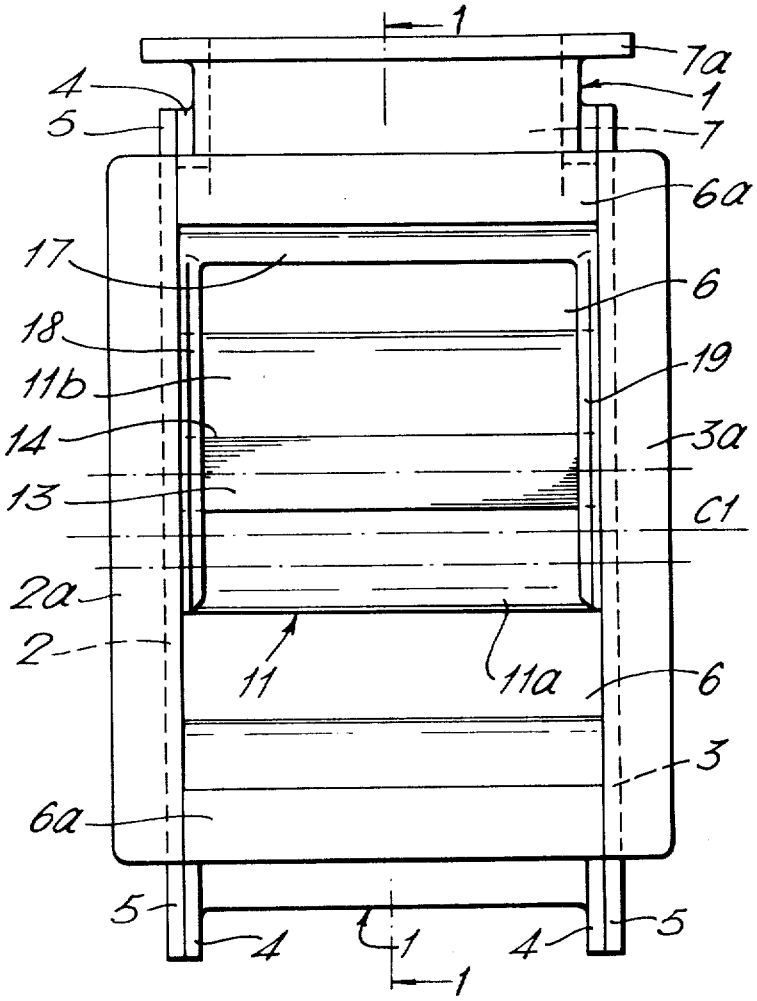
FIG. 2 is a view in the direction of the arrows 2-2 on FIG. 1, the rotor being in a position with horizontal blades.

In FIGS. 1 and 2 there is shown a pump casing consisting of a main part 1 and two side covers 2, 3 which by means of substantially radial flanges 4 and 5 on the main part and the covers, respectively, and appropriate not shown fixing means are affixed to each side of the main part 1.

The main part 1 has an inlet 6 and an outlet 7 which is formed with flanges 6*a* and 7*a*, respectively, for together with suitable flange sections 2*a* and 3*a*, respectively, on the side covers 2 and 3, respectively, to allow for the connection of an inlet conduit and an outlet conduit, respectively.

The main part 1 has an inner main surface 8 extending between the inlet 6 and the outlet 7 and therebetween having an approximately circular cross-section with a radius of curvature R1. At the inlet 6 and the outlet 7, respectively, the main surface 8 merges with interim sections 9 and 10, respectively. In the pump casing there is provided a rotor 11 which is eccentrically mounted relatively to the central axis C1 of the main surface. The rotor is mounted in suitable bearings 12 in the covers 2, 3. In the shown embodiment the rotor 11 consists of two equal parts 11*a* and 11*b*, respectively, which by means of the bearing means 12 are kept suitably spaced from each other for thereby defining an intermediate recess 14 wherein a double blade 13 formed as a flat disc-shaped piece can move. The recess 14 and the blade 13 extend substantially across the whole width of the pump casing, i.e. between the two side covers 2, 3, and the blade 13 is formed with rounded end sections 13*a*.

The two equal parts 11a and 11b of the rotor have opposite surface sections 11aa and 11bb, respectively, which at their edges extending transversely relatively to the direction of transportation adjoin with approximately circularly arced surfaces 11cc and 11dd, respectively, having a radius of curvature R2 which is less than the radius of curvature R3 of the circumscribed circle of the rotor. The circularly arced surfaces 11cc and 11dd evenly merge with approximately equal opposite concave surface sections 11ee and 11ff, respectively. Preferably the radius of curvature R4 of the concave surface sections 11*ee* and 11*ff* is chosen of the same order as the radius R3 of the circumscribed circle of the rotor, but must be generally adapted to the other pump dimensions to give a desired favourable pumping effect.

Between the inlet 6 and the outlet 7 the main part 1 is formed with an inwardly protruding section 15, the extreme edge 16 of which is positioned approximately at a distance R1 from the central axis C1 of the main surface. A flap 17 shaped as a bowed plate extending across the full width of the inlet is affixed to two arms 18, 19, which is pivotably mounted on shaft journals 20 in the side covers 2, 3. The convex curvature of the flap 17 corresponds to the convex curvature of the upper entering section 21 of the inlet, and by means of not shown devices the flap 17 is with its rounded front section 22 pressed against the surface of the rotor. The flap 17 which preferably consists of a hard rubber material at least in its front section, will thus during the rotating motion of the rotor all the time abut against the surface of the rotor with an appropriate sealing pressure and at the same time swing forth and back on the journals 20 depending on the relative position between the front section 22 of the flap and the actual point of connection on the surface of the rotor.

In the transition section 10 of the main surface 8 there is arranged a first transverse slot 23 which at the exterior is connected to a supply conduit 24. Through the supply conduit 24 there may be supplied liquid under pressure, e.g. water or other liquid, which does not unfavourably influence the material to be transported. Likewise, there is at the transition section 9 of the main surface 8 provided a second transverse slot 25 which is connected to a second supply conduit 26. Through this a liquid of suitable consistency and pressure may be supplied. Preferably the supply conduits 24 and 26 may be connected to a storage tank wherein the transported inhomogeneous material is present, so that the liquid in the storage tank may circulate in the system. When such a liquid is tapped from the storage tank the pressure of the added liquid corresponds to the pressure which during operation is present at the outlet side of the pump.

During operation the rotor 11 is rotated by means of not shown external drive means, e.g. an electrical motor, and at a certain point of time the rotor will have the position which is shown in FIG. 1. The double blade 13 at its rounded end section 13*a* then tightly abuts against the transition sections 9 and 11 so that a closed working volume or working chamber is defined between the blade 13 and the main surface 8. As the front section 22 of the flap 17 is pressed against the surface of the rotor and the flap 17 with its convex top portion rests against the entering section 21 of the inlet 6 the flap forms a division between the inlet 6 and the outlet 7. Against the rotor 11 there will now in that position of the blade which is shown in FIG. 1 rest a counter pressure which in liquid level corresponds to the level at which the transported material is present above the pump. At the inlet 6 there now exists the danger that the material which is transported will be subjected to a shearing or cutting effect between the blade end 13*a* and the transition section 9 of the main part. During this transition period, i.e. when the end section 13*a* of the blade 13 enters the transition section 9, liquid under pressure is supplied via the supply conduit 26 through the slot 25. This reduces the risk of damaging the material which is to be transported, to a minimum.

When the blade end leaves the abutment against the transition section 10 upon passing into the outlet 7 there will, due to the pressure difference existing between the outlet and the working volume, exist a risk for the inhomogeneous material at the outlet side of the pump being pressed between the blade end 13*a* and the end of the main surface 8 before a pressure equalization can take place. A sprayer of finely divided fish material (cream of fish) will thereby occur, something which, naturally, is undesired. When the blade portion 13*a* passes the section 10 one may, however, via the supply conduit 24 supply liquid under pressure through the slot 24. The supplied liquid is preferably under the same pressure which exists at the outlet side. The squeezing of the transported material between the blade end 13*a* and the section 10 is thereby counteracted as a pressure equalization between the outlet 7 and the working chamber is established.

During the further rotation of the rotor 11 the upper blade end which protrude from the rotor will enter the area of the outlet 7 and therein be subjected to the outlet pressure. Due to the eccentric arrangement of the rotor in the rotor casing the blade, accordingly, will slide in the recess 14 between the rotor parts 11*a*, 11*b*, so as to press the opposite blade end against the main surface 8, the flap 17 all the time forming a bar between the inlet 6 and the outlet 7.

When one of the end sections 13a of the blade 13 passes by the section 15 of the main part 1 which inwardly protrude between the inlet 6 and the outlet 7 the flap 17 will be in its most outward position and the blade portion 13*a* will then coincide with the adjoining sections 11*cc* and 11*dd* of the rotor, respectively. The blade 13 itself will then be displaced from its centre position a distance corresponding to the eccentricity E, I.e. it will at the opposite end protrude from the rotor a distance corresponding to 2E. After the blade portion 13*a* has passed the section 15 and enters the inlet 6 the position of the blade will be controlled by the guidance of the opposite blade end along the main surface 8. This situation is maintained until the blade ends are rotated 180° and anew take the same position as shown in FIG. 1. Thereupon the next cycle is repeated for the next 180°, etc.

Possibly, there may in the inlet and outlet sections of the main part be arranged shoulder guidances for the blades 13. The displacement of the blade may then be independent of the pressure existing at the outlet side, but in such a construction it is on the other side necessary to give the mechanical design details of the pump more attention.

Figure 3:
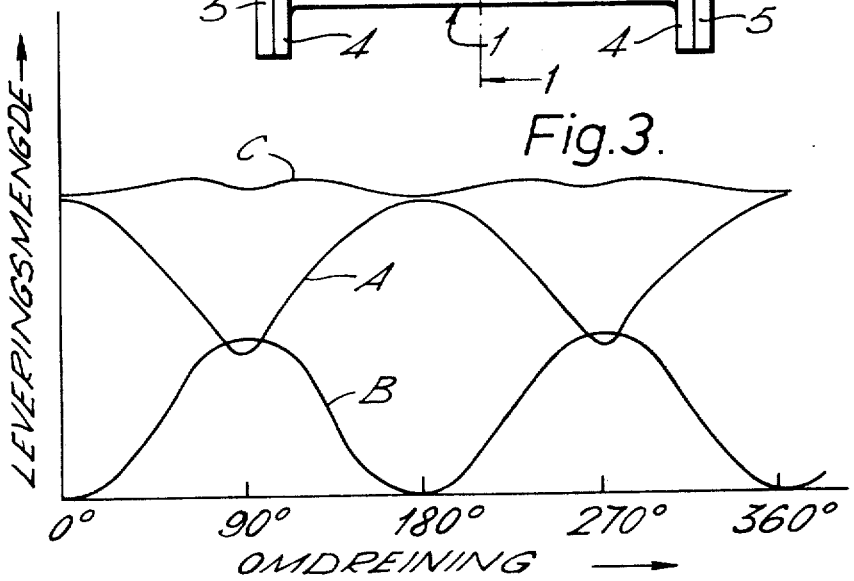
FIG. 3 is a diagram showing the delivery characteristic of the pump according to the invention compared with the characteristic of a conventional pump.

The diagram in FIG. 3 shows an example of a delivery characteristic C which may be achieved with the pump according to the invention. The curve C is composed of the curve A which indicates the delivery characteristic of a blade pump of conventional type, and the curve B which indicates the delivery characteristic of a pump without blades but with a profiled rotor. Besides from achieving a larger capacity with the pump according to the invention also the delivery characteristic thereof may be made very even.

The pump according to the invention is especially suited for closed transportation of whole fish from fishing vessels to a weighing apparatus on the quay and/or from the weighing apparatus to the storage tank. The pump with conduits may for the transportation of whole fish from the vessel to the quay either depend from a hoisting boom or be constructed as a self-supported structure with hydraulic movements. Before the transportation of the fish from the measuring/weighing apparatus on the quay to the storage tanks the pump according to the invention may be connected to a stationary closed pipe conduit system.

The described embodiment of the rotor may, of course, be varied within wide limits without going beyond the idea or the scope of the invention. The principle thing is that the volume of the rotor has to be made as small as possible and the contour thereof to be made with uniform transition sections for the flap 17 to slide easily along the surface of the rotor. For example the actual sections of the rotor which lie within the circumscribed circle of the rotor, may be formed flat or ellipse-shaped. By an appropriate selection of dimensions one may achieve a delivery characteristic for the pump which is substantially quiet.

The eccentricity of the rotor and the construction of the blades can also be varied within the scope of the invention.

The guiding of the flap along the surface of the rotor can be provided by means of biasing means or slide means guided by force. Further, the supply of pressure water to the slots in the transition sections of the main surface may be regulated in dependence of the position of the blade ends in the working chamber. This may be accomplished either by means of valves or sluices which are controlled automatically. By altering the eccentricity of the rotor there may be achieved an alteration in the swinging movement of the flap, said swinging movement desirably being kept as small as possible.

The advantages obtained by the pump according to the invention compared with known displacement pump of the blade or vane type can be summarized as follows:

a. The pump according to the invention yields an approximate even delivery, and the delivery is very gentle as only two blades are used.

b. The pump according to the invention gives favourable inlet and outlet conditions, the rotor shape in its tilted position giving larger inlet and outlet ports compared with known blade pumps with cylindrical rotor.

c. By profiled rotor and especially when the rotor is shaped as a number eight, the rotor itself will over larger areas thereof serve as a shovel advancing the material ahead of itself together with the blades.

d. Due to the profiled rotor and the pivotable flap the pump according to the invention renders a new displacement volume which is added to the volume which is characteristic for known blade pumps, the new displacement volume coming into effect 90° phase shifted relatively to the pumping volume of conventional blade pumps.

e. The pump yields a greater capacity, i.e. larger gross volume, compared with usual blade pumps.

The pump according to the invention has found application in the food industry for transporting delicate raw material which requires gentle transportation, especially in the fish flour and fish oil industry wherein the raw material consists of whole fish. Previously known pumps for pumping of fish from the cargo compartment in the fishing vessels cannot be used right away as the fish in that case must be mixed with water in a ratio one part fish to two parts water, something which entails must refuse water which is very difficult to dispose of due to pollution problems. By using the pump according to the invention such mixing problems are avoided as the pump without any addition of surplus water to the fishing load pumps the fish directly from the cargo compartment to the fabric. It should be noted that compared with unloading with hoisting machinery a pump according to the invention may accomplish the work 2½ times as fast and at the same time release man power.

What I claim is:

1. A rotary pump comprising a. a casing defining a working chamber with substantially circular cross section of a given radius (R1), and which is provided with an inlet and an outlet arranged substantially right-angled to each other and together extending across at least one quarter of the surface of the case and communicating with said working chamber, b. a rotor eccentrically arranged in said working chamber, said rotor having two blades which are arranged in opposite recesses in a rotor boss, and which during operation are pressed against the inner surface of the working chamber, said two-bladed rotor being profiled and having a cross section along its complete length which is defined by a fixed curve which in the areas of the blade recesses have convex portions (11*cc*, 11*dd*) coinciding with approximately circularly arched portions having a first radius of curvature (R2) which is less than the smallest circumscribed circle of the cross section, and which in the areas between the blade recesses have concave portions (11*ee*, 11*ff*) coinciding with approximately circularly portions having a second radius of curvature (R4) which is less than said given radius (R1), said concave portions (11*ee*, 11*ff*) being located inside the smallest circumscribed circule of the corss section and evenly merging with said convex portions (11*c*, 11*dd*), and c. a pivotable flap extending substantially along the complete width of said profiled rotor, and being arranged between the outlet and the inlet of the casing, said flap having an edge which during the rotation of the rotor slidingly abuts against said the outer surface of the rotor.

2. Improvement in a rotary pump with a pivoted flap engaging a profiled rotor, said pump comprising a casing defining a working chamber with a substantially circular cross section of a given radius (R1), and which is provided with an inlet and an outlet substantially right-angled to each other and together extending across at least one quarter of the surface of the casing and communicating with said working chamber, said profiled rotor having oval shape and being arranged concentrically in said working chamber, the extremeties of said rotor, during operation, abutting against the inner surface of the casing for thereby inducing a first pumping effect so as to transport the material in first partial volumes with a first pulsating characteristic having two maxima and two minima for every full rotation of the rotor, means sealing between the inlet and the outlet of the casing being provided by a flap edge which edge slidingly abuts against the profiled surface of the rotor, the improvement comprising:

a. said profiled rotor being given a cross section which is substantially less than said oval section, the radius (R3) of the smallest circumscribed circle thereof being substantially less than said given radius (R1) of the casing, b. said profiled rotor being arranged eccentrically in said working chamber and equipped with two oppositely arranged blades which are retractably mounted in recesses in the rotor boss, and which during operation are pressed against the inner surface of the working chamber, the eccentricity being defined along a line substantially extending from the area between the inlet and the outlet and through the center of the casing, c. said profiled rotor along its complete length being given a cross section defined by a fixed curve which in the areas of the blade recesses have convex portions (11*cc*, 11*dd*) coinciding with approximately circularly arched portions having a first radius of curvature (R2) which is less than said radius (R3) representing the smallest circumscribed circle of the cross section, and which curve in the areas between the blade recesses have concave portions (11*ee*, 11*ff*) coinciding with approximately circularly arced portions having a second radius of curvature (R4) which is less than said given radius (R1), said concave portions (11*ee*, 11*ff*) being located inside the smallest circumscribed circle of the cross section and evenly merging with said convex portions (11*cc*, 11*dd*).

d. said flap with its edge, during operation, slidingly abutting against said circumferential portions of the rotor, for thereby inducing a second pumping effect so as to transport material in second partial volumes with a second pulsating characteristic having two maxima and two minima for every full rotation of the rotor, the maxima of said second pulsating characteristics coinciding with the minima of said first pulsating characteristic, and the minima of said second pulsating characteristic coinciding with the maxima of said first pulsating characteristic, for thereby yielding a greater total pump capacity and giving a more even total supply characteristic of said pump.

3. In a rotary pump with a bladed rotor, said pump comprising a casing defining a working chamber with a substantially circular cross section of a given radius (R1), said casing being provided with an inlet and outlet substantially right angled to each other and together extending along at least one quarter of the inner circumferential surface of the casing and communicating with said working chamber, said bladed rotor having a cylindrical path of rotation defining a second radius (R3), said bladed rotor being arranged eccentrically in said working chamber and having two oppositely disposed blades which are reciprocatingly mounted in recesses in a rotor boss and which, during operation, are normally urged against the inner circumferential surface of the working chamber, sealing means between the outlet and inlet comprising a substantially stationary portion of the casing abuttingly engagable against the surface of the bladed rotor for thereby inducing a first pumping effect so as to transport material in first partial volumes with a first pulsating characteristic having two maxima and two minima for every full rotation of the rotor, the improvement in which a. said two-bladed motor being profiled along its length, having a cross section defined by a fixed curve which, in the areas of the blade recesses, have convex portions (11*cc*, 11*dd*) merging into circular portions having a first radius of curvature (R2) which is less than a second radius (R3) comprising the smallest circumscribe circle of the cross-section, and which curve, in the areas between the blade recesses, have concave portions (11*ee*, 11*ff*) coinciding with circular portions having a second radius of curvature (R4) which is less than said given radius (R1), said concave portions (11*ee*, 11*ff*) being located inside the smallest circumscribed circle of the cross section and merging with said convex portion (11*c*, 11*dd*), b. said substantially stationary portion of the casing between said outlet and inlet including a displacable flap extending across the width of said profiled rotor, said flap having an edge which during the rotation of the rotor, slidingly abuts against the outer surface portion of the rotor, for inducing a second pumping effect so as to transport material in second partial volumes with a second pulsating characteristic having two maxima and two minima for every rotation of the rotor, the maxima of said second pulsating characteristic coinciding with the minima of said first pulsating characteristic and the minima of said second pulsating characteristic coinciding with the maxima of said first pulsating characteristic, for thereby yielding a greater total pump capacity and providing smooth total supply characteristics to said pump.

4. A pump as claimed in claim 3, wherein said displacable flap (17) is normally biased onto the outer surface of the rotor for yielding a desired pressure between the flap (17) and the rotor (13).

5. A pump as claimed in claim 3, in which said displacable flap (17) is pivotedly mounted and includes means for guiding the flap (17) for synchronously movement of the flap in relation to rotary movement of the rotor.

6. A pump as claimed in claim 3, wherein said second radius of curvature (R4) of the concave portions (11*ee*, 11*ff*) is coordinated to the eccentricity (E) of the rotor.

7. A pump as claimed in claim 6, wherein said second radius of curvature (R4) of said concave portions (11*ee*, 11*ff*) is of substantially the same magnitude as said radius of curvature (R2) of said convex portions (11*cc*, 11*dd*).

* * * * *